US005940107A

United States Patent [19]

Fox

[11] Patent Number: 5,940,107

[45] Date of Patent: Aug. 17, 1999

[54] METHOD AND APPARATUS FOR PRINTING ON A LINERLESS MEDIA USING A TEMPORARY LINER IN THE PRINT ZONE

[75] Inventor: Duane M. Fox, Snohomish, Wash.

[73] Assignee: Intermec Corporation, Everett, Wash.

[21] Appl. No.: 08/369,955

[22] Filed: Jan. 9, 1995

[51] Int. Cl.[6] ..... B41J 2/32

[52] U.S. Cl. ..... 347/171; 347/218; 101/288

[58] Field of Search ..... 347/171, 215, 347/218; 101/288; 156/384

[56] References Cited

U.S. PATENT DOCUMENTS

| | | | |
|---|---|---|---|
| 4,262,591 | 4/1981 | Cook | 101/92 |
| 4,650,350 | 3/1987 | Dorner | 400/120 |
| 5,060,009 | 10/1991 | Milovanovich | 355/27 |
| 5,437,228 | 8/1995 | Uland | 101/288 |
| 5,560,293 | 10/1996 | Boreali et al. | 101/288 |

*Primary Examiner*—Huan Tran
*Attorney, Agent, or Firm*—Donald A. Streck; Joan H. Pauly

[57] ABSTRACT

This is a printer for printing on a printing face of a strip media having adhesive on a back face opposite the printing face. There is a moving surface of a release material which does not bond to the adhesive extending linearly between an entrance and an exit of a print zone to provide a temporary liner supporting strip media within the print zone. A drive mechanism moves the strip media through the print zone in combination with the temporary liner. A printhead is located within the print zone for printing on strip media within the print zone. Finally there is a member which non-contactingly releases strip media emerging from the print zone from the temporary liner.

18 Claims, 4 Drawing Sheets

METHOD AND APPARATUS FOR PRINTING ON A LINERLESS MEDIA USING A TEMPORARY LINER IN THE PRINT ZONE

BACKGROUND OF THE INVENTION

1. Technical Field

This invention relates to printers for printing on media such as labels and, more particularly, to a printer for printing on a printing face of a strip media having adhesive on a back face opposite the printing face comprising, a moving surface of a release material which does not bond to the adhesive extending linearly between an entrance and an exit of a print zone to provide a temporary liner supporting strip media within the print zone; means for moving strip media through the print zone in combination with the temporary liner; a printhead located within the print zone for printing on strip media within the print zone; and, means for non-contactingly releasing strip media emerging from the print zone from the temporary liner.

2. Background Art

Methods and apparatus for printing strip, roll-fed, media such as labels are well known in the art. Where there is no adhesive backing or the adhesive backing is temporarily covered with a removable liner material, the printer 10 can be configured as in FIG. 1. The printer 10 has a supply roll 12 of media 14, a fixed platen 16, and a printhead 18 positioned over the platen 16. The media 14 passes between the platen 16 and the printhead 18 and is pulled through by a pair of drive rollers 20. If the print surface of the media 14 is thermally activated, only a thermal printhead 18 is required. If the print surface of the media 14 is printed by thermal transfer or impact printing, an ink ribbon 22 from a supply roll 24 to a take-up roll 26 is also required in addition to the appropriate printhead 18. Where used, the ribbon 22 passes between the printhead 18 and the print surface of the media 14.

More recently, for various reasons of no importance to this application, so-called "linerless" media has gained great popularity. The linerless media has adhesive backing but no easily removable liner over it. Thus, it is susceptible to sticking to surfaces within a printer in which it is used. If the fixed platen 16 of FIG. 1 is employed, the results can be as in FIG. 2 where the adhesive on the media 14' has adhered to the surface of the platen 16 and the media 14' has been broken from the pulling force of the drive rollers 20. The loose end of the media 14' has also wound itself around the bottom drive roller 20 by adhering thereto and any inertia of the supply roll 12 has caused the media 14' to bunch up against the platen 16 and printhead 18. All in all, to try that approach could result in possible disaster for the user.

As another approach, the prior art has suggested employing a platen roller 25 of sufficient diameter to support the media 14' under the printhead 18 as depicted in FIG. 3. This suggested approach is also fraught with possible problems as depicted in the figure. Like the approach of FIG. 2, the media 14' may wind itself around the bottom drive roller 20 by adhering thereto. It may also adhere to the platen roller 25 until pulled off by the drive rollers 20 or adhere more fully to the platen roller 25 and pull the media 14' back through the drive rollers 20 or break it. To prevent such a happening, it has been suggested to put little fingers in strategic locations to pick the media 14' free from the platen roller 25 should it become attached to the surface thereof. All in all, another approach that could result in problems of disastrous results for the user and an overly complex design.

In European Patent Application 0 577 241 A2 of Thomas P. Nash as assigned to Moore Business Forms, Inc. which claims priority of U.S. application Ser. No. 907,511 filed Jan. 7, 1992 and which European Patent Application was published on May 5, 1994 in Bulletin 94/01 there is a printing apparatus which non-contactingly prints on pre-cut labels having a linerless adhesive employing an ink-jet type of printer. FIG. 4 depicts the apparatus and, in general, is the same as FIG. 1 of that application. The linerless media 50 has a printing surface 52 and an adhesive surface 54. The media 50 comes off the roll through rollers 56 and 58 which drive the media 50 to a cutting station 60, The cutting station 60 cuts the media 50 into labels 62 which are held onto the surface of the large roller 64 by atmospheric pressure as a result of a vacuum maintained within the roller 64. The printing surface 52 is adjacent the surface of the roller 64 and the adhesive surface 54 faces outward. The labels 62 are delivered by the roller 64 onto a transport system 66 which comprises a plurality of spaced tube belts 68 which rotate longitudinally in the direction of the arrows. There is also a vacuum chamber 70 under the belts 68. Thus, the labels 62 are deposited onto the belts 68 with the adhesive surface 54 contacting the belts 68. Since there is so little contact area between the adhesive surface 54 and the circular cross-section tube belts 68, it is necessary to have the vacuum chamber 70 which sucks between the belts 68 thereby causing atmospheric pressure to hold the labels on the belts 68.

As the labels 62 move along the belts 68, the release-coated printing surface 52 is heated by a hot platen 72 so that the ink will stick to the printing surface 52. After the platen 72 has heated the printing surface 52, a hot-melt wax ink-jet printer 74 sprays the "printing" onto the labels 72. At the end of the belts 68, there are a plurality of rollers 76 disposed between the spaced tube belts 68. The rollers 76 have an outside diameter which is greater than the thickness of the tube belts 68. Thus, the rollers 76 push the labels 72 up and off of the belts 68; and, in cooperation with opposing pinch rollers 78, push the printed labels 72 onto the surface of a product, such as envelopes 80, which are moved along the path 82 by the transport system 84.

As can be appreciated, the above-described apparatus is costly, bulky, and complicated. It certainly is not adapted to printing linerless labels in a portable and lightweight manner. The vacuum supply alone negates any possibility of using such technology in a portable lightweight printer. The requirement that the printhead be non-contacting so that ink-jet printing requiring pre-heating of the release coating on the printing surface is also self-defeating to the idea of a small, inexpensive, and lightweight portable printer for linerless media.

Wherefore, it is an object of the present invention to provide a drive and support mechanism and method for linerless media when printing thereupon by any approach using a printhead requiring support of the media in the print zone.

It is another object of the present invention to provide a drive mechanism and method for linerless media when printing thereupon by any approach using a printhead in which the media cannot adhesively seize and be broken.

It is still another object of the present invention to provide a drive and support mechanism and method for linerless media when printing thereupon by any approach using a printhead which is simple in design and construction.

It is yet another object of the present invention to provide a drive and support mechanism and method for linerless media which does not require a vacuum supply.

Other objects and benefits of this invention will become apparent from the description which follows hereinafter when read in conjunction with the drawing figures which accompany it.

SUMMARY OF THE DISCLOSURE

The foregoing objects have been attained by the printer of the present invention for printing on a printing face of a strip media having adhesive on a back face opposite the printing face comprising, a moving surface of a release material which does not bond to the adhesive extending linearly between an entrance and an exit of a print zone and across the width of the media to provide a temporary liner supporting strip media within the print zone; means for moving strip media through the print zone in combination with the temporary liner; a printhead located within the print zone for printing on strip media within the print zone; and, means for non-contactingly releasing strip media emerging from the print zone from the temporary liner.

In the preferred embodiment, the moving surface of a release material comprises a wide, flat, belt. Preferably, the belt is of polytetrafluorethylene plastic. Also, there are a pair of rollers having parallel spaced axes of rotation defining the print zone having the belt passing therearound and moving in combination therewith.

The preferred means for moving strip media through the print zone comprises means for rotationally driving one of the pair of rollers.

The preferred means for non-contactingly releasing strip media emerging from the print zone from the temporary liner comprises a strip roller positioned just past a one of the pair of rollers at the exit of the print zone and at a level to contact an inside top surface of the belt at substantially a same level as the one of the pair of rollers, the strip roller being of a diameter smaller than the pair of rollers and small enough to attempt to bend media emerging from the one of the pair of rollers to a degree greater than tacky adherence of the adhesive can maintain against a restorative bias of the media whereby the adhesive releases from the belt and the media continues out of the print zone.

In total, the preferred embodiment additionally comprises, a pair of rollers having parallel spaced axes of rotation defining the print zone; drive means for rotationally driving one of the pair of rollers; a polytetrafluorethylene plastic belt disposed over the pair of rollers to be driven in combination therewith, the polytetrafluorethylene plastic belt providing a release surface facing into the print zone which adhesive on the back face of a strip of media in the print zone abuts against in tacky but not adhesively attached contact; and, a strip roller positioned just past a one of the pair of rollers at the exit of the print zone and at a level to contact an inside top surface of the belt at substantially a same level as the one of the pair of rollers, the strip roller being of a diameter smaller than the pair of rollers and small enough to attempt to bend media emerging from the one of the pair of rollers to a degree greater than tacky adherence of the adhesive can maintain against a restorative bias of the media whereby the adhesive releases from the belt and the media continues out of the print zone.

DETAILED DESCRIPTION OF THE PREFERRED EMBODIMENT

Figure 1:
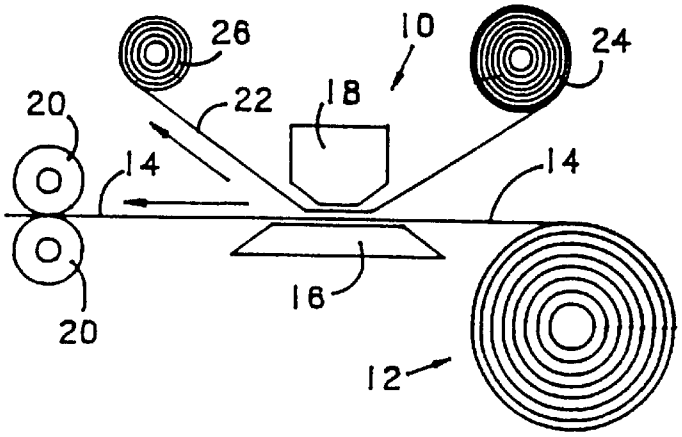
PRIOR ART FIG. 1
FIG. 1 is a simplified side view drawing of a prior art label printer employing a fixed platen for supporting non-adhesive backed or lined media in the print zone.
Figure 2:
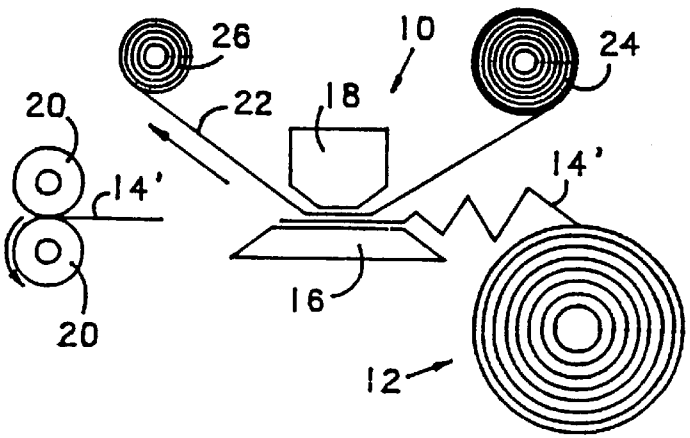
PRIOR ART FIG. 2
FIG. 2 is a simplified side view drawing of a prior art label printer employing a fixed platen for supporting adhesive backed, linerless media in the print zone and depicting what can happen if that is attempted.
Figure 3:
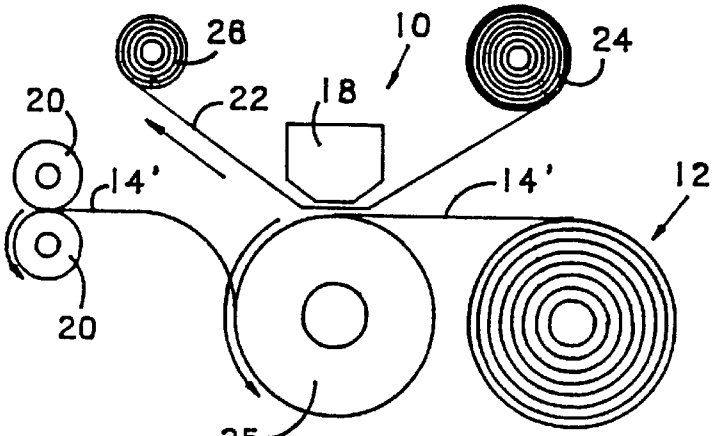
PRIOR ART FIG. 3
FIG. 3 is a simplified side view drawing of a prior art label printer employing a roller for supporting adhesive backed, linerless media in the print zone and depicting what can happen if that is attempted.
Figure 4:
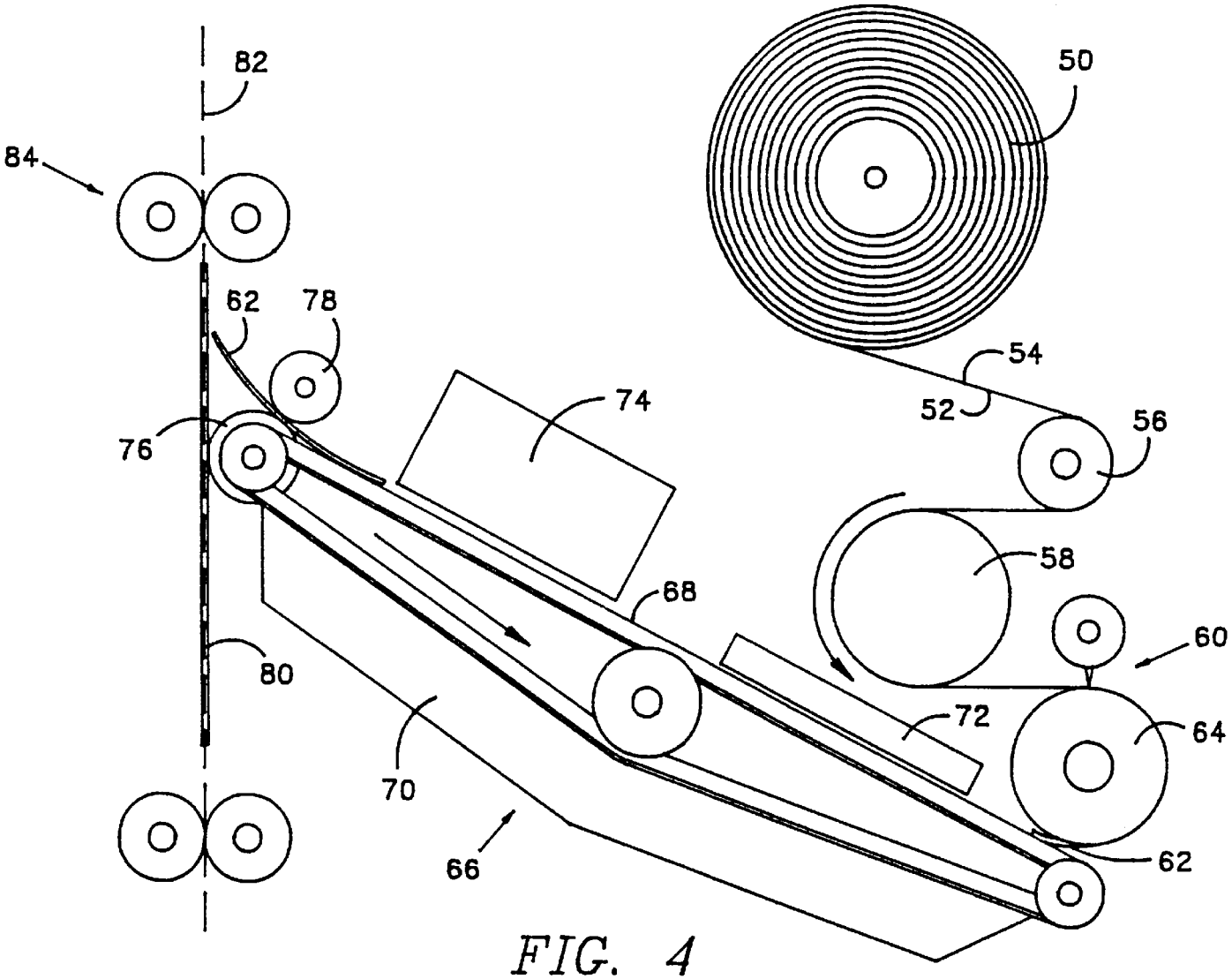
FIG. 4 PRIOR ART
FIG. 4 is a simplified side view drawing of a prior art label printer employing a plurality of tube belts and a vacuum chamber for moving pre-cut, adhesive backed, linerless labels past a non-contacting inkjet printer and directly onto a receiving surface.
Figure 5:
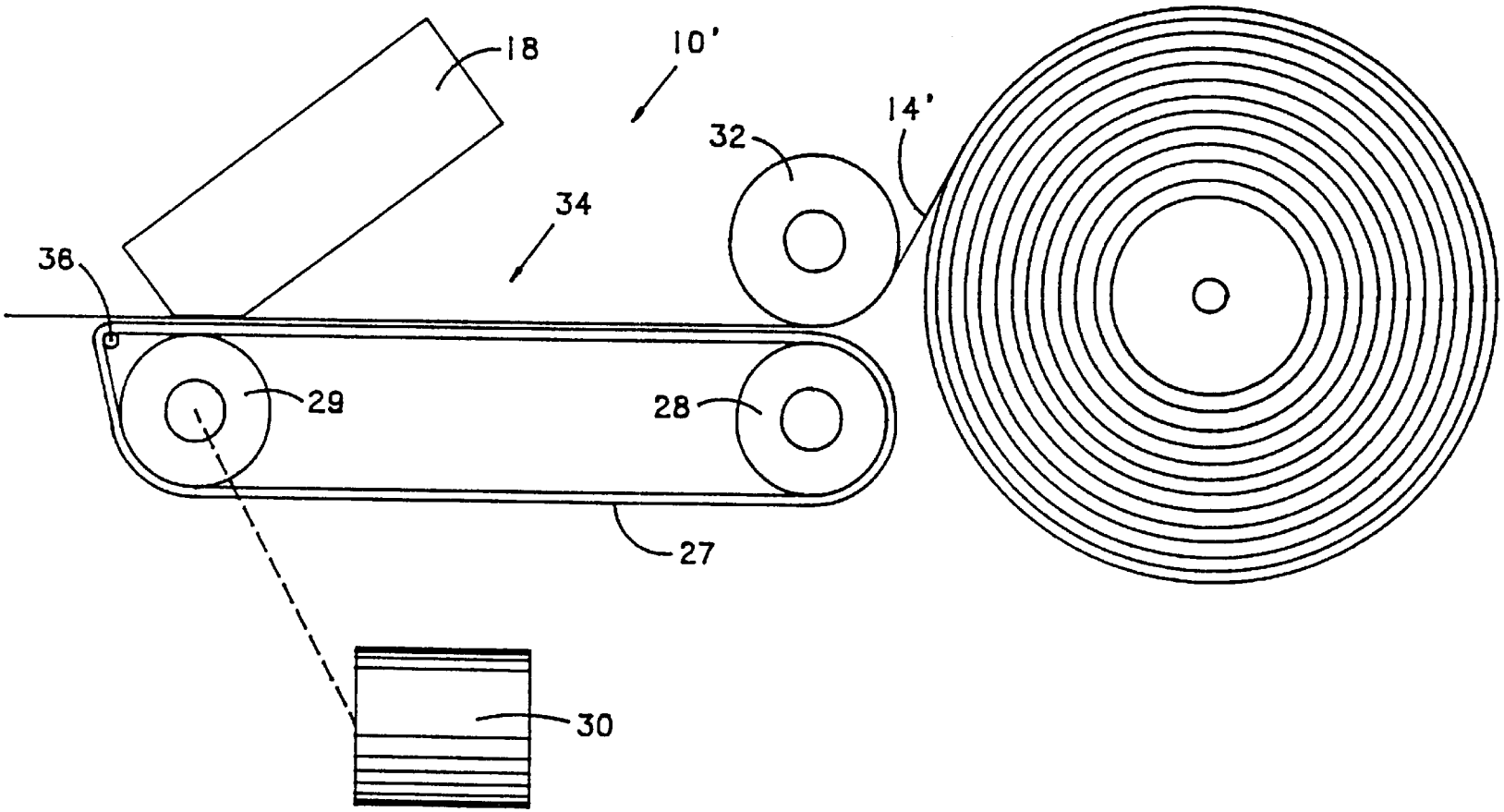
FIG. 5 is an enlarged, simplified, side view drawing of a label printer according to the present invention employing a belt as a temporary liner for supporting adhesive backed, linerless media in the print zone.
Figure 6:
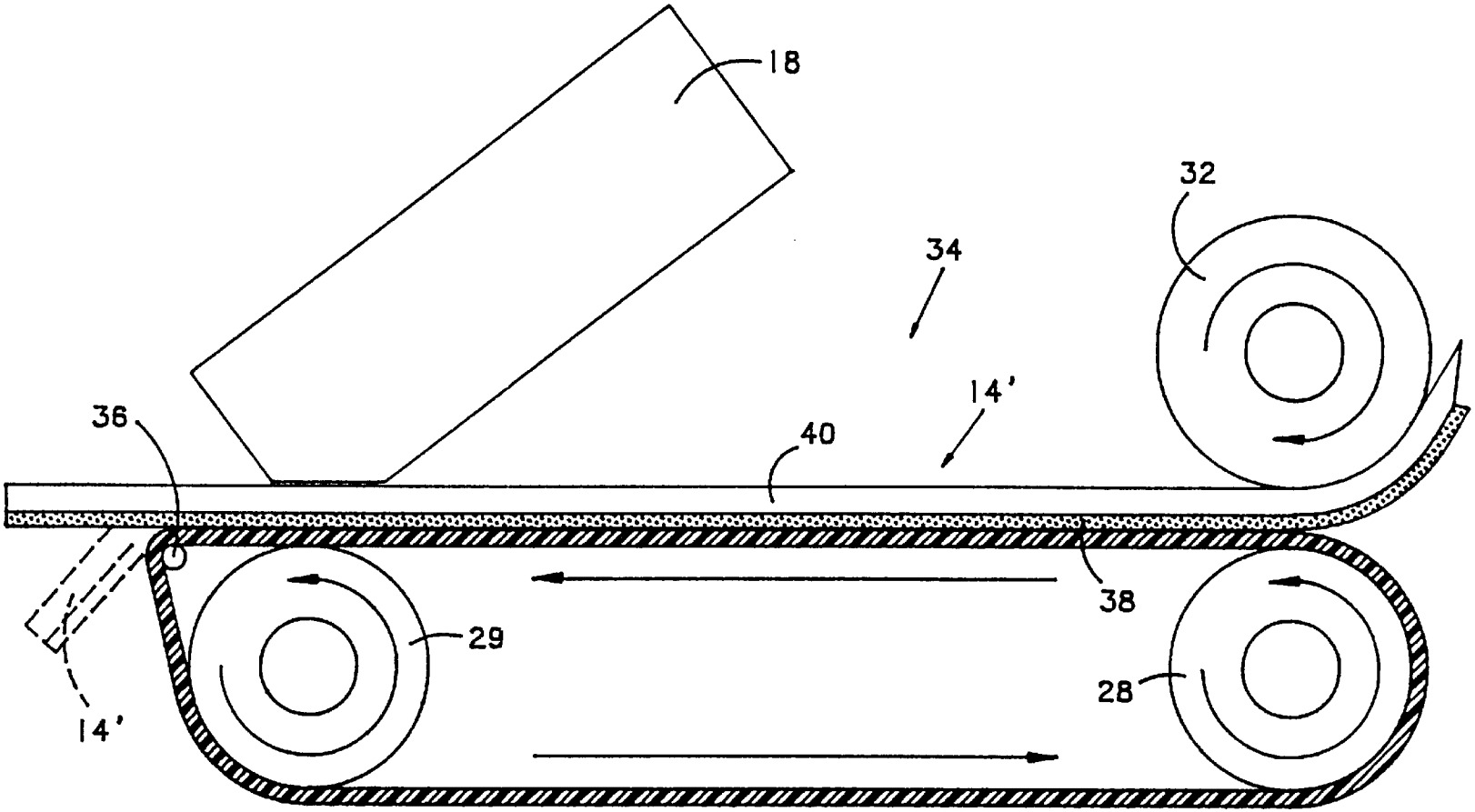
FIG. 6 is a greatly enlarged, partially cutaway, simplified, side view drawing of a label printer according to the present invention employing a belt as a temporary liner for supporting adhesive backed, linerless media in the print zone with the media not drawn to scale and depicting how the invention works to accomplish its objectives.

The objects of the present invention are obtained by employing a belt having a release surface in contact with the adhesive to act as a temporary liner for the linerless media within the print zone as depicted in FIGS. 5 and 6. As will also be seen, the present invention pushes the media through the print zone from within the print zone rather than pulling it from outside of the print zone or transporting pre-cut lengths of the media through the print zone as in the prior art.

It should be noted in passing that the media in FIG. 6 is not drawn to scale, but rather, shown in greater thickness so that the details of the material and its adhesive backing can be seen. This approach was used for clarity and easy understanding of the drawing only and not intended to be exact.

The printer 10' of this invention has a belt 27 equal or greater in width than the media 14' stretched between two rollers 29 and 28. The surface of the belt 27 contacting the media 14' can be flat or be textured, as desired. The object is to have the media 14' have sufficient tacky adherance to the surface of the belt 27 such that the media 14' is transported thereby; but, does not permanently adhesively attach thereto so that it can be removed from the belt 27 at the desired time easily and without damage to either the belt 27 or the media 14'. The belt 27 could also comprise a plurality of close-spaced flat belts providing sufficient support for the media 14' at the print station and sufficient surface for tacky adhereance. This is in contrast to the prior art device described in detail above which employs tube belts which provide a minimum of contact area with the adhesive thereby requiring a vacuum system to hold the media to the tube belts.

As depicted, roller 29 is a driven roller driven by a conveyor drive, in FIG. 5 the drive motor 30, while roller 28 is an idler roller. The two could, of course, be reversed without changing the operation of the invention. As the driven roller 29 rotates, it drives the belt 27 and the idler roller 28. A pinch roller 32 is positioned over the idler roller 28 at the entrance to the print zone 34. The printhead 18 is positioned over the driven roller 29 at the exit from the print zone 34. In addition, the belt 27 passes over a small diameter strip roller 36 located just past the printhead 18 at the exit of the print zone 34. The operation of the strip roller 36 will be addressed in detail shortly.

In the preferred embodiment, the belt 27 is constructed of polytetrafluorethylene plastic of the type sold under the trademark Teflon. Such plastic material is highly resistive to chemicals, temperatures, and the like, and, of equal importance, it has a surface which is naturally resistive to adhesives so that the belt 27 acts like a temporary liner with respect to the adhesive 38 on the back of the media material 40. Other belt materials could, of course, be employed by putting a known release material such as silicone, varnish, or the like, on the adhesive-facing surface. Such an approach is simply not preferred for obvious reasons of long use life, etc.

The pinch roller 32 in combination with the idler roller 28 and belt 27 draws the media 14' into the print zone 34 from the supply roll 12. As mentioned above, there is a tacky adhesion of the adhesive 38 to the surface of the belt 27 which also aids in moving the media 14' through the print zone 34 from within the print zone 34. Thus, the media 14' is well supported at the location of the printhead 18 and close tolerances can be maintained between the printhead 18 and the top print surface of the media material 40 as necessary for clean and clear printing thereon by whatever printing technique is employed.

After being printed upon by the printhead 18, the media 14' arrives at the strip roller 36. The strip roller 36 has a very small diameter as compared with the drive roller 29, causing the belt 27 to bend sharply back upon itself at that point. The media material 40 has a degree of stiffness to it, being typically of a heavy-weight paper stock or a light-weight card stock as compared with a light-weight material such as so-called "onion skin" or the like. Being unable to bend quickly to the ghosted position of FIG. 5 and not being strongly attached to the surface of the belt 27, the media 14' simply snaps away from its mere tacky adherence to the surface of the belt 27 and continues in a forward direction out of the print zone 34. This is in contrast to the above-described prior art in which the larger rollers at the end of the tube belt actually contacted, lifted and pushed the labels off the belt. After printing and leaving the print zone 34, the media 14' can be separated by perforations therein or by a cutter mechanism as well known in the art. As those of ordinary skill in the art will undoubtedly recognize and appreciate, the strip roller 36 could have a smooth surfaced rod substituted for the roller. A roller is preferred, however, as it will add to the life and performance of both the strip roller 36 and the belt 27.

It should be noted in passing that because of the tacky adherence of one layer to the other within the supply roll 12, linerless media takes more effort to pull it from the supply roll 12. Because the belt 27 aids the action of the pinch roller 32 and idler roller 28 in pulling the media 14' from the supply roll 12, the present invention is more easily able to accomplish this task than a mere pair of drive rollers as in the prior art.

Wherefore, having thus described the present invention, what is claimed is:

1. A printer for printing on a printing face of a linerless strip media having adhesive on a back face opposite the printing face comprising:

a) a pair of rollers having parallel spaced axes of rotation defining a print zone having an entrance and an exit, one of said rollers being powered to rotate about its axis of rotation;

b) a flat belt disposed over said pair of rollers to be driven in combination therewith, said belt having a release surface facing into said print zone which adhesive across the back face of the strip media in said print zone abuts against in tacky but not adhesively attached contact;

c) a printhead confronting said belt in said print zone to cooperate with a platen to print on the printing face of the strip media in said print zone; and d) a strip roller positioned just past a first one of said pair of rollers at said exit of said print zone and at a level to contact an inside top surface of said belt at substantially a same level as each roller of said pair of rollers, to provide a linear path for the strip media throughout said print zone from said entrance to said exit and beyond said print zone to said strip roller, said strip roller being of a diameter smaller than said pair of rollers and small enough to attempt to bend the strip media emerging from said print zone to a degree greater than tacky adherence of the adhesive can maintain against a restorative bias of said strip media whereby said adhesive releases from said belt and said strip media continues out of said print zone and linearly beyond said strip roller.

2. The printer for printing on a printing face of a strip media having adhesive on a back face opposite the printing face of claim 1 wherein:

said belt is of polytetrafluorethylene plastic.

3. The printer of claim 1, which further comprises a pinch roller confronting an outside top surface of said belt at said entrance of said print zone opposite a second one of said pair of rollers, to cooperate with said second one of said pair of rollers to draw the strip media into said print zone; and in which said belt forms a closed loop passing around said pair of rollers and said strip roller, said loop having an upper run that defines said linear path and that has opposite ends at which said belt turns to extend around said strip roller and said second one of said pair of rollers, respectively, to inhibit contact between said strip media and said belt outside said upper run.

4. The printer of claim 1, wherein said platen comprises said first one of said pair of rollers.

5. A printer for printing on a printing face of a linerless strip media having adhesive on a back face opposite the printing face comprising:

a) a pair of rollers having parallel spaced axes of rotation defining a print zone having an entrance and an exit extending linearly between top contact points of respective ones of said pair of rollers, one said rollers being powered to rotate about its axis of rotation;

b) a flat belt disposed over said pair of rollers to be driven in combination therewith, said belt having an adhesive resistant release surface facing into said print zone;

c) a printhead confronting said belt in said print zone to cooperate with a platen to print on the printing face of the strip media in said print zone; and d) a stripping member positioned just past a first one of said pair of rollers at said exit of said print zone, said stripping member having a contact surface contacting an inside top surface of said belt in linear alignment with said top contact points of said pair of rollers, to provide a linear path for the strip media throughout said print zone from said entrance to said exit and beyond said print zone to said strip roller, said stripping member being sized and positioned so as to attempt to bend the strip media emerging from said print zone to a degree greater than tacky adherence of the adhesive can maintain against a restorative bias of said strip media whereby said adhesive releases from said belt and said strip media continues out of said print zone and linearly beyond said stripping member.

6. The printer for printing on a printing face of a strip media having adhesive on a back face opposite the printing face of claim 5 wherein:

said stripping member is a rod.

7. The printer for printing on a printing face of a strip media having adhesive on a back face opposite the printing face of claim 5 wherein:

said stripping member is a roller.

8. The printer for printing on a printing face of a strip media having adhesive on a back face opposite the printing face of claim 5 wherein:

said belt is of polytetrafluorethylene plastic.

9. The printer of claim 5, which further comprises a pinch roller confronting an outside top surface of said belt at said entrance of said print zone opposite a second one of said pair of rollers, to cooperate with said second one of said pair of rollers to draw the strip media into said print zone; and in which said belt forms a closed loop passing around said pair of rollers and said stripping member, said loop having an upper run that defines said linear path and that has opposite ends at which said belt turns to extend around said stripping member and said second one of said pair of rollers, respectively, to inhibit contact between said strip media and said belt outside said upper run.

10. The printer of claim 5, wherein said platen comprises said first one of said pair of rollers.

11. A printer for printing on a printing face of a linerless strip media having adhesive on a back face opposite the printing face comprising:

a) a pair of rollers having parallel spaced axes of rotation defining a print zone having an entrance and an exit;

b) a driver rotationally driving one of said pair of rollers;

c) a flat belt disposed over said pair of rollers to be driven in combination therewith, said belt having a release surface facing into said print zone which adhesive across the back face of the strip media in said print zone abuts against in tacky but not adhesively attached contact;

d) a printhead confronting said belt in said print zone to cooperate with a platen to print on the printing face of the strip media in said print zone; and e) a strip roller positioned just past a first one of said pair of rollers at said exit of said print zone and at a level to contact an inside top surface of said belt at substantially a same level as each roller of said pair of rollers, to provide a linear path for the strip media throughout said print zone from said entrance to said exit and beyond said print zone to said strip roller, said strip roller being of a diameter smaller than said pair of rollers and small enough to attempt to bend the strip media emerging from said print zone to a degree greater than tacky adherence of the adhesive can maintain against a restorative bias of said strip media whereby said adhesive releases from said belt and said strip media continues out of said print zone and linearly beyond said strip roller.

12. The printer for printing on a printing face of a strip media having adhesive on a back face opposite the printing face of claim 11 wherein:

said belt is of polytetrafluorethylene plastic.

13. The printer of claim 11, which further comprises a pinch roller confronting an outside top surface of said belt at said entrance of said print zone opposite a second one of said pair of rollers, to cooperate with said second one of said pair of rollers to draw the strip media into said print zone; and in which said belt forms a closed loop passing around said pair of rollers and said strip roller, said loop having an upper run that defines said linear path and that has opposite ends at which said belt turns to extend around said strip roller and said second one of said pair of rollers, respectively, to inhibit contact between said strip media and said belt outside said upper run.

14. The printer of claim 11, wherein said platen comprises said first one of said pair of rollers.

15. A printer for printing on a printing face of a linerless strip media having adhesive on a back face opposite the printing face comprising:

a) a belt conveyor including a pair of rollers having parallel spaced axes of rotation defining a print zone having an entrance and an exit, and a flat belt passing around said pair of rollers, said belt having a release surface facing into said print zone which adhesive across the back face of the strip media in said print zone abuts against in tacky but not adhesively attached contact;

b) a conveyor drive engaging said conveyor to move said rollers of said pair of rollers in combination with said belt;

c) a printhead confronting said belt in said print zone to cooperate with a platen to print on the printing face of the strip media in said print zone; and d) a strip roller positioned just past a first one of said pair of rollers at said exit of said print zone and at a level to contact an inside top surface of said belt at substantially a same level as each roller of said pair of rollers, to provide a linear path for the strip media throughout said print zone from said entrance to said exit and beyond said print zone to said strip roller, said strip roller being of a diameter smaller than said pair of rollers and small enough to attempt to bend the strip media emerging from said print zone to a degree greater than tacky adherence of the adhesive can maintain against a restorative bias of said strip media whereby said adhesive releases from said belt and said strip media continues out of said print zone and linearly beyond said strip roller.

16. The printer of claim 15, wherein said belt is of polytetrafluorethylene plastic.

17. The printer of claim 15, which further comprises a pinch roller confronting an outside top surface of said belt at said entrance of said print zone opposite a second one of said pair of rollers, to cooperate with said second one of said pair of rollers to draw the strip media into said print zone; and in which said belt forms a closed loop passing around said pair of rollers and said strip roller, said loop having an upper run that defines said linear path and that has opposite ends at which said belt turns to extend around said strip roller and said second one of said pair of rollers, respectively, to inhibit contact between said strip media and said belt outside said upper run.

18. The printer of claim 15, wherein said platen comprises said first one of said pair of rollers.

* * * * *